United States Patent [19]

Bright

[11] Patent Number: 4,947,475

[45] Date of Patent: Aug. 7, 1990

[54] LIGHT EMITTING DEVICES

[75] Inventor: Alfred N. Bright, Marlow, England

[73] Assignee: Saunders-Roe Development Limited, United Kingdom

[21] Appl. No.: 314,843

[22] Filed: Feb. 24, 1989

[30] Foreign Application Priority Data

May 26, 1988 [GB] United Kingdom ..... 8812496

[51] Int. Cl.[5] ..... F21K 2/00

[52] U.S. Cl. ..... 362/34; 362/390; 362/225; 362/249; 250/462.1

[58] Field of Search ..... 362/34, 84, 252, 225, 362/390, 228, 249; 250/486.1, 483.1, 487.1, 462.1

[56] References Cited

U.S. PATENT DOCUMENTS

| | | | |
|---|---|---|---|
| 2,410,277 | 10/1946 | Farris | 250/462.1 |
| 4,112,485 | 9/1978 | Sutter | 362/390 |
| 4,546,417 | 10/1985 | Watts | 362/390 |
| 4,788,437 | 11/1988 | Urquhart et al. | 250/462.1 |
| 4,796,161 | 1/1989 | Savariego | 362/34 |

*Primary Examiner*—Ira S. Lazarus
*Assistant Examiner*—D. M. Cox
*Attorney, Agent, or Firm*—Larson and Taylor

[57] ABSTRACT

A light emitting device in which annular self luminous light sources are supported intermediate the ends of a resilient rod. In an illustrated embodiment a plurality of the rods are located concentrically within a transparent tube between end caps which close the ends of the tube.

8 Claims, 1 Drawing Sheet

LIGHT EMITTING DEVICES

FIELD OF THE INVENTION

This invention relates to light emitting devices and is particularly concerned with such devices that use one or more self luminous light sources consisting of a phosphor coating within a translucent envelope which is excited to luminescence by a gaseous radionucleide such as tritium.

DESCRIPTION OF THE PRIOR ART

Such light sources are manufactured by applicant under the Trade Mark "BETALIGHT" and Registered Trade Marks "SRDL" and "SRDL BETALIGHT", and have been proposed for use in potentially hazardous environments such as for taxiway markers on airport runways. Problems associated with such an application is the requirement to provide a large light source to provide a useful light intensity which requires a large amount of expensive radioactive gas, and the potential release of such a large amount of gas that could occur in the event that the device suffers impact damage.

U.S.-A-4,546,417 discloses an annular self luminous light source and mentions briefly the utilisation of the central axial space to attach the source to a mounting, for example, using an axial dowel.

The prior specification is also concerned with protection of the light source against impact damage and, in one embodiment, the light source is retained within an outer transparent casing by threaded end caps and is supported from the internal surface by annular rubber shock absorbers. In another embodiment an annular rubber spacer for cushioning the light tube includes an integral central plug for location in the central axial space, however, the disclosure clearly specifies that such a device can be used only over the ends of the light source.

SUMMARY OF THE INVENTION

According to one aspect of this invention, a light emitting device comprises at least one annular self luminous light source wherein the or each said annular light source is supported intermediate the ends of a resilient rod located through the light source.

Each rod may consist of a silicon rubber material and, preferably, may be transparent silicon rubber material.

In another aspect the invention provides a light emitting device comprising a transparent tube supported between end caps substantially closing the ends of the tube, and at least one annular self luminous light source supported intermediate the ends of a resilient rod located through the light source and between the end caps.

The end caps may be retained by an axial tension bar extending through the tube and, preferably, the tension bar has a reflective external surface.

In one form of the invention a plurality of resilient rods each supporting at least one annular self luminous light source may be located concentrically of the tension bar. Preferably, at least two annular light sources may be located on each resilient rod and may be separated by a spacer adapted to prevent contact between the adjacent ends of the light sources and the surface of the rod or the transparent tube.

Conveniently, the spacer is a single spacer interconnecting the plurality of resilient rods.

In yet another aspect a lighting device comprises a circular transparent tube supported between end caps substantially closing the ends of the tube and retained by an axial tension bar extending through the tube, a plurality of resilient rods located concentrically within the tube between the end caps, each rod extending through at least one annular self luminous light source to support the light source in a substantially free floating manner whereby the damage tolerance characteristics of the device are enhanced.

BRIEF DESCRIPTION OF THE DRAWINGS

The invention will now be described by way of example only and with reference to the accompanying drawings in which.

DETAILED DESCRIPTION OF THE DRAWINGS

Figure 1:
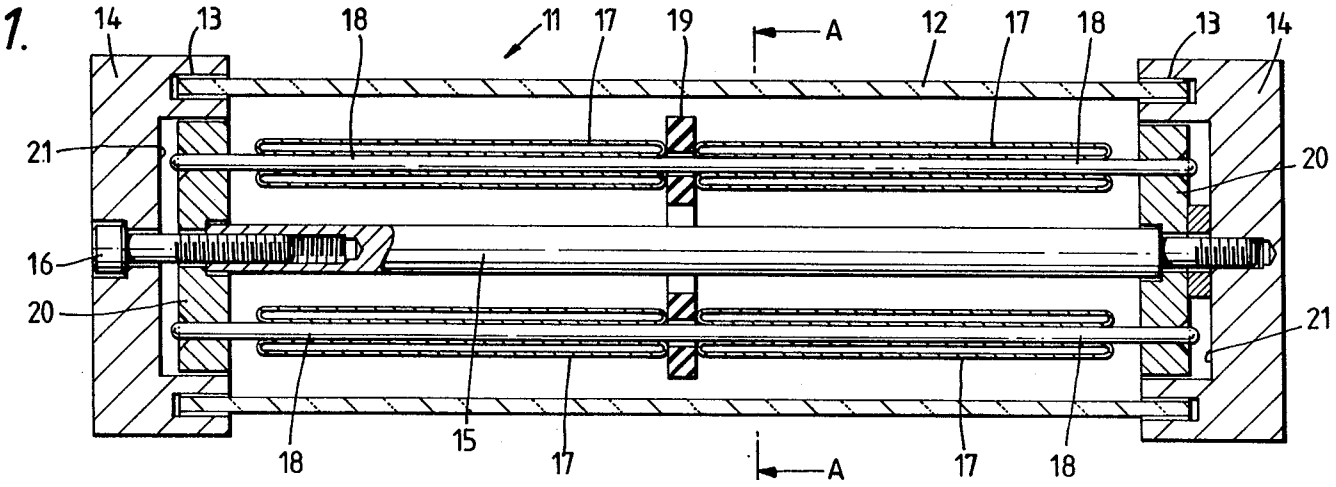
FIG. 1 is a transverse cross sectional view of a light emitting device constructed in accordance with the invention.
Figure 2:
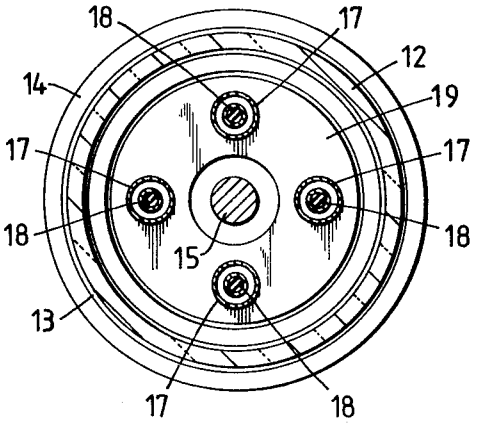
FIG. 2 is a fragmentary sectioned view taken in lines A—A of FIG. 1.

A light emitting device 11 includes a circular transparent acrylic tube 12 located at both ends in annular grooves 13 in end caps 14 closing the ends of the tube and retained in appropriate spaced-apart relationship by an axially extending tension bar 15 retained by a bolt 16. The tension bar 15 has a highly reflective external surface.

Two annular self luminous light sources 17 are retained on each of four transparent silicon rubber rods 18 equi-spaced circumferentially around the tension bar 15 and extending longitudinally through the tube 12 between the end caps 14.

The light sources 17 on each of the rods 18 are separated by a single silicon rubber central annular spacer 19 which also interconnects the four rods 18.

Protruding ends of each of the rods 18 are secured through holes in end support plates 20 located in recesses 21 in each of the end caps 14, and are secured by adhesive (not shown).

The external diameter of the silicon rubber rods 18 is greater than the internal diameter of the annular light sources 17 so as to provide firm retention of the light sources. To facilitate assembly the rods 18 are produced with an excess length portion of reduced diameter to allow it to be threaded through the centre of the light sources 17, and the rods 18 are stretched to reduce their effective diameter to allow the light sources 17 to be slid into place. When the tension on the rod 18 is released it returns to its nominal diameter to firmly grip the light sources 17, and the reduced diameter portion is removed.

The invention facilitates the use of a plurality of annular self luminous light sources 17 to provide the required light intensity for a particular application which is enhanced by the use of the transparent rods which allow full light transmission, and by the reflective external surface of the tension bar 15.

Important features of the invention are the use of a plurality of small diameter annular light sources which minimises the amount of tritium required for a given light output, and the resilient support of the light sources 17 by the silicon rubber rods 18 which provides a freely floating support that greatly enhances damage tolerance characteristics. In the illustrated embodiment in which two light sources 17 are located on each rod 18, the central spacer 19 serves to prevent contact between adjacent inner ends of the light sources 17 and between the inner ends and either the internal surface of the tube 12 or the external surface of the tension bar 15 that might otherwise occur in an impact.

Although the light emitting device has been described and illustrated with reference to a particular application, it will be understood that the described resilient support means for the light sources may be used in many other applications especially those in which impact damage tolerance is an important consideration.

Whilst one embodiment has been described and illustrated it will be understood that many modifications may be made without departing from the scope of the invention as defined in the appended claims. For example, the tube 12 may be other than circular in cross-sectional shape and any desired number of rods 18 and attached light sources 17 may be used. The rods 18 need not be arranged concentrically and may be concentrated in an arc within the tube. The actual number of light sources 17 mounted on each rod 18 can be varied to suit a particular application.

What is claimed is:

1. A light emitting device comprising a transparent tube supported between end caps substantially closing the ends of the tube, at least one annular self luminous light source supported intermediate the ends of a resilient rod located through the light source and between said end caps, and an axial tension bar extending through the tube and retaining the end caps.

2. A device as claimed in claim 1, wherein the resilient rod consists of silicon rubber material.

3. A device as claimed in claim 2, wherein said silicon rubber material is transparent.

4. A device as claimed in claim 1, wherein said tension bar has a reflective external surface.

5. A device as claimed in claim 1, wherein a plurality of resilient rods each supporting at least one annular self luminous light source are located concentrically of the tension bar.

6. A device as claimed in claim 5, wherein at least two annular light sources are located on each resilient rod and are separated by a spacer adapted to prevent contact between the adjacent ends of the light sources on each rod and between the ends of the light sources and the surface of the rod or the transparent tube.

7. A device as claimed in claim 6, wherein said spacer is a single spacer interconnecting said plurality of resilient rods.

8. A light emitting device comprising a circular transparent tube supported between end caps substantially closing the ends of the tube and retained by an axial tension bar extending through the tube, a plurality of resilient rods located concentrically within the tube between the end caps, each rod extending through at least one annular self luminous light source to support the light source in a substantially free floating manner whereby the damage tolerance characteristics of the device is enhanced.

* * * * *